US009431713B2

(12) United States Patent
Singh

(10) Patent No.: US 9,431,713 B2
(45) Date of Patent: Aug. 30, 2016

(54) CIRCULARLY-POLARIZED PATCH ANTENNA

(71) Applicant: Rosemount Aerospace Inc., Burnsville, MN (US)

(72) Inventor: Donald R. Singh, Apple Valley, MN (US)

(73) Assignee: Rosemount Aerospace Inc., Burnsville, MN (US)

( * ) Notice: Subject to any disclaimer, the term of this patent is extended or adjusted under 35 U.S.C. 154(b) by 162 days.

(21) Appl. No.: 14/296,766

(22) Filed: Jun. 5, 2014

(65) Prior Publication Data

US 2015/0357718 A1 Dec. 10, 2015

(51) Int. Cl.

| | |
|---|---|
| ***H01Q 1/38*** | (2006.01) |
| ***H01Q 9/04*** | (2006.01) |
| ***H01Q 1/24*** | (2006.01) |
| ***H01Q 1/48*** | (2006.01) |

(52) U.S. Cl.

CPC ..... *H01Q 9/0428* (2013.01); *H01Q 1/24* (2013.01); *H01Q 1/38* (2013.01); *H01Q 1/48* (2013.01); *H01Q 9/045* (2013.01); *H01Q 9/0442* (2013.01)

(58) Field of Classification Search

CPC ..... H01Q 1/38; H01Q 9/0428; H01Q 9/045
USPC ..... 343/700 MS, 702, 829, 846
See application file for complete search history.

(56) References Cited

U.S. PATENT DOCUMENTS

| | | | | |
|---|---|---|---|---|
| 5,241,321 | A * | 8/1993 | Tsao | H01Q 9/0435 343/700 MS |
| 5,410,323 | A | 4/1995 | Kuroda | |
| 7,427,957 | B2 * | 9/2008 | Zeinolabedin Rafi | H01Q 9/0414 343/700 MS |
| 8,319,694 | B2 * | 11/2012 | Yang | H01Q 1/2216 340/572.7 |
| 2006/0097922 | A1 * | 5/2006 | Mahmoud | H01Q 9/0428 343/700 MS |
| 2006/0139212 | A1 | 6/2006 | Reuss | |
| 2009/0140930 | A1 | 6/2009 | Tatarnikov et al. | |

FOREIGN PATENT DOCUMENTS

DE 19758217 A1 7/1999

OTHER PUBLICATIONS

Abramowitz, M. and Stegun, I.A., "Handbook of Mathematical Functions With Formulas, Graphs, and Mathematical Tables" National Bureau of Standards Applied Mathematics Series 55, Issued Jun. 1964, Tenth Printing, Dec. 1972.

R. B. Waterhouse, "Small microstrip patch antenna", Electronics Letters, Apr. 13, 1995, vol. 31, No. 8.

(Continued)

*Primary Examiner* — Tho G Phan
(74) *Attorney, Agent, or Firm* — Kinney & Lange, P.A.

(57) ABSTRACT

In one example, a patch antenna includes a conductive ground plane layer, a conductive circular patch layer, a dielectric layer, a grounding connection, and a RF feed. The conductive circular patch layer includes a plurality of voids. The dielectric layer is disposed between and contacts each of the ground plane layer and the circular patch layer. The grounding connection extends from the ground plane layer through the dielectric layer and contacts the circular patch layer at a grounding location of the circular patch layer. The RF feed extends through the ground plane layer and the dielectric layer and contacts the circular patch layer at a RF feed location of the circular patch layer. The RF feed location is offset from a central axis of the circular patch layer.

12 Claims, 5 Drawing Sheets

(56) References Cited

OTHER PUBLICATIONS

F. Ali and J.B. Horton, "Introduction to Special Issue on Emerging Commercial and Consumer Circuits Systems, and Their Applications", IEEE Trans. Micro. Theory & Tech., MTT-43, pp. 1633-1638, Jul. 1995.
R.B. Waterhouse, S.D. Targonski, "Performance of Microstrip Patches Incorporating a Single Shoring Post", Antennas and Propagation Society International Symposium, 1996. AP-S. Digest, pp. 29-32 vol. 1.
Kin-Lu Wong and Yi-Fang Lin, Circularly polarised microstrip antenna with a tuning stub, Electronic Letters, Apr. 30, 1998, vol. 34 No. 9.
T.F. Lai, Wan nor Liza Mahadi, Norhayati Soin, "Circular Patch Microstrip Array Antenna for KU-band", World Academy of Science, Engineering and Technology 48 2008.
Asghar Keshtkar, Ahmad Keshtkar, and A.R. Dastkhosh, "Circular Microstrip Patch Array Antenna for C-Band Altimeter System", Hindawi Publishing Corporation, International Journal of Antennas and Propagation, vol. 2008, Article ID 389418, 7 pages.
Patch antenna, from Wikipedia, the free encyclopedia, http://en.wikipedia.org/wiki/Patch_antenna, undated.
I.J.Bahl and P. Bhartia, "Circular Microstrip Antennas", Microstip Antennas, Chapter 3, pp. 83-138, 1980.
The European Search Report mailed Aug. 20, 2015 for European Application No. 15169626.7.

* cited by examiner

CIRCULARLY-POLARIZED PATCH ANTENNA

BACKGROUND

The present disclosure relates to planar patch antennas, and in particular to circular patch antennas having circular polarization.

Patch antennas, also referred to as microstrip antennas, are often used in radio frequency (RF) systems due to their small size, light weight, low profile, low cost, and ease of fabrication and assembly. Patch antennas typically include a conductive (e.g., metallic) patch portion separated from a large metallic ground plane by a low-loss dielectric spacer, such as quartz, alumina, ceramics, or other dielectric materials. The patch portion, separated from the ground plane by the dielectric, is typically energized via a RF feed. The patch portion and ground plane together form a transmission line that radiate electromagnetic fields from the edges of the patch. The resonant frequency (and hence the wavelength) of the antenna is dependent upon factors such as the size of the patch, the size of the ground plane, and the thickness and dielectric constant of the dielectric spacer.

Typically, such antennas utilize a patch portion that is approximately one-half of a wavelength of the frequency of operation. For instance, a patch antenna having a nominal operational frequency within the 2.4 gigahertz (GHz) Industrial, Scientific, and Medical (ISM) radio band may typically utilize a patch portion approximately 2.5 inches (6.35 centimeters) long, corresponding to approximately one-half of the wavelength of a 2.4 GHz signal in free space. As such, the size of the patch can make it difficult to integrate patch antennas into certain assemblies (e.g., sensors, transmitters, and the like) having size requirements that are less than the half-wavelength size of a signal at a specified nominal operational frequency (e.g., less than 2.5 inches in the case of a 2.4 GHz signal). Typically, patch antenna require electrically large ground planes (e.g., five times the size of the patch or more), thereby further impeding such integration efforts. Integration of patch antennas into certain assemblies, such as assemblies having metal housings, can further complicate matters by introducing proximity effects which can change the resonant frequency, as well as the bandwidth (BW).

Miniaturization efforts have been undertaken to help reduce the size of patch antennas. Resulting techniques have disclosed that the use of a dielectric spacer having a higher dielectric constant can decrease the size of the patch portion of the antenna, but at the expense of a reduced bandwidth. In addition, circular polarization can be helpful in operation in harsh operations. However, inciting circular polarization within a patch may typically require the use of a quadrature coupler that equally splits a RF power feed into multiple (e.g., two) phase-shifted signals that feed the patch at multiple points (e.g., opposite edges). Such quadrature couplers can be bulky in comparison to the patch antenna, thereby impeding miniaturization and integration efforts. Accordingly, it can be difficult to integrate patch antennas into assemblies having metal housings that are smaller than the half-wavelength size of a signal at a specified nominal operational frequency of the antenna.

SUMMARY

In one example, a patch antenna includes a conductive ground plane layer, a conductive circular patch layer, a dielectric layer, a grounding connection, and a RF feed. The conductive circular patch layer includes a plurality of voids. The dielectric layer is disposed between and contacts each of the ground plane layer and the circular patch layer. The grounding connection extends from the ground plane layer through the dielectric layer and contacts the circular patch layer at a grounding location of the circular patch layer. The RF feed extends through the ground plane layer and the dielectric layer and contacts the circular patch layer at a RF feed location of the circular patch layer. The RF feed location is offset from a central axis of the circular patch layer.

In another example, an assembly includes an electronics module, a patch antenna, and an electrical cable. The patch antenna includes a conductive ground plane layer, a conductive circular patch layer, a dielectric layer, a grounding connection, and a RF feed. The conductive circular patch layer includes a plurality of voids. The dielectric layer is disposed between and contacts each of the ground plane layer and the circular patch layer. The grounding connection extends from the ground plane layer through the dielectric layer and contacts the circular patch layer at a grounding location of the circular patch layer. The RF feed extends through the ground plane layer and the dielectric layer and contacts the circular patch layer at a RF feed location of the circular patch layer. The RF feed location is offset from a central axis of the circular patch layer.

DETAILED DESCRIPTION

According to techniques described herein, a patch antenna includes a conductive ground plane layer separated from a conductive circular patch layer by a dielectric layer. A grounding connection extends from the ground plane, through the dielectric layer, and contacts the circular patch at a grounding location. A radio frequency (RF) feed contacts the patch at an RF feed location that is offset from a central axis of the patch. The offset RF feed location can excite multiple resonant modes of the patch, thereby inciting circular polarization of the antenna to help improve the efficiency of the antenna system. In this way, a patch antenna according to techniques of this disclosure can be circularly-polarized without the use of a quadrature coupler or other phase-shifting device which may increase the size of the antenna system. In some examples, the dielectric layer can be formed of a material having a relatively high dielectric constant (e.g., alumina), thereby reducing the diameter of the patch. For instance, in certain examples, an antenna implementing techniques of this disclosure can have a nominal operational frequency in the 2.4 gigahertz (GHz) Industrial, Scientific, and Medical (ISM) radio band, but a patch diameter of less than one inch (as opposed to a 2.5-inch diameter corresponding to the half-wavelength of a 2.4 GHz signal in air).

The patch can include a plurality of voids that can impede the flow of a portion of the surface currents on the patch, thereby effectively increasing the diameter of the patch and resulting in an increased bandwidth of the antenna. In some examples, the antenna can include a "finite" ground plane (i.e., a ground plane layer that is less than five times the diameter of the patch). For instance, in certain examples, the diameter of the circular patch layer can be nearly equal to the diameter of the ground player layer. Accordingly, a patch antenna implementing techniques of this disclosure can have an outer diameter that is significantly less than a half-wavelength of a signal at a nominal operational frequency (e.g., less than half of the half-wavelength) while maintaining sufficient bandwidth. Moreover, the circularly-polarized patch antenna can be mounted within a housing, such as a metal housing, without significantly reducing the performance of the antenna.

Figure 1:
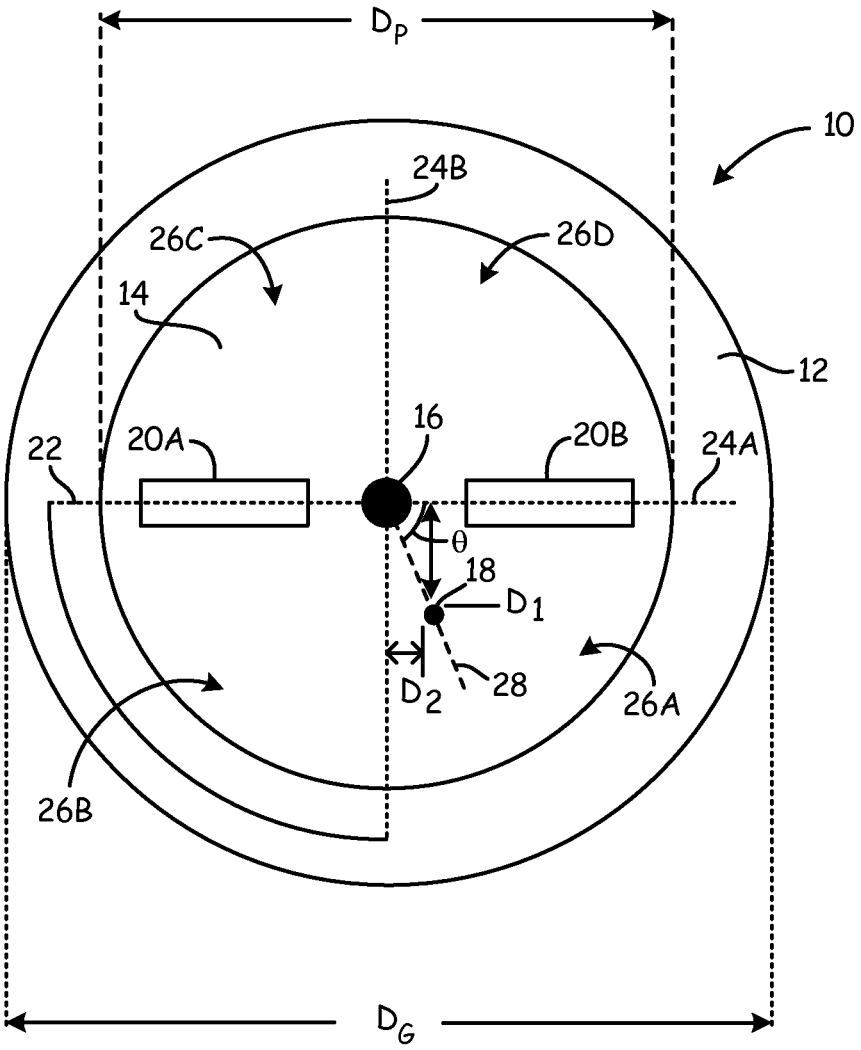
FIG. 1 is a schematic diagram of a top view of a patch antenna having a conductive ground plane layer and a conductive circular patch layer.

FIG. 1 is a schematic diagram of a top view of patch antenna 10 having ground plane layer 12 and patch layer 14. As illustrated, patch layer 14 can include grounding location 16, RF feed location 18, voids 20A and 20B (collectively referred to herein as "voids 20"), and tuning portion 22.

As in the example of FIG. 1, patch layer 14 can be a circular patch having diameter $D_P$ and formed of metal (e.g., copper) or other highly conductive material. Likewise, ground plane layer 12 can be formed of metal (e.g., copper) or other highly conductive material. Ground plane layer 12, as illustrated in FIG. 1, can be circular, having diameter $D_G$. In other examples, ground plane layer 12 can have other shapes, such as square, rectangular, oval, or other regular or irregular shapes. Ground plane layer 12 is separated from patch layer 14 (and tuning portion 22) by a dielectric layer, as is further described below.

Patch layer 14 is electrically connected to ground plane layer 12 via a grounding connection that extends from ground plane layer 12, through the dielectric layer, and contacts patch layer 14 at grounding location 16, as is further described below. As illustrated in FIG. 1, grounding location 16 can be disposed at a central axis of patch layer 14 (i.e., an axis that extends through a center point of patch layer 14, out of the page in the illustrated example). In other examples, grounding location 16 can be disposed at a location that is offset from the central axis of patch layer 14. In general, grounding location 16 provides a shorting location for current to flow from RF feed location 18 to ground plane layer 12.

RF feed location 18, as illustrated in FIG. 1, is disposed at a location of patch layer 14 that is offset from the central axis of patch layer 14 (i.e., the axis extending through patch layer 14 at grounding location 16 in this example). For instance, axis 24A and axis 24B (collectively referred to herein as "axes 24") can be perpendicular axes that each intersect the central axis of patch layer 14 to divide patch layer 14 into four quadrants 26A-26D (collectively referred to herein as "quadrants 26"). As illustrated, RF feed location 18 can be disposed at a location of patch layer 14 that is distance D1 from axis 24A and distance D2 from axis 24B. Distance D1 and distance D2 can be the same or different distances, each ranging from zero to fifty percent of a diameter of patch layer 14. In certain examples, distance D1 and distance D2 can be selected such that angle θ, measured between line 28 extending from the central axis of patch layer 14 to feed location 18 and axis 24A extending through voids 20, is approximately forty-five degrees, such as within a range from forty-three degrees to forty-seven degrees.

In some examples, RF feed location 18 can be determined based on an impedance matching of a RF feed line (e.g., a coaxial cable) that supplies a RF signal to patch layer 14 at RF feed location 18. For instance, RF feed location 18 can be selected as a location of patch layer 14 having an impedance that most closely matches an impedance of the RF feed line (e.g., fifty ohms), thereby increasing efficiency of power transfer from the RF feed line to patch layer 14. In the example of FIG. 1, an impedance of patch layer 14 at grounding location 16 is effectively zero, and an impedance at the periphery of patch layer 14 approaches infinity, or open circuit. The grounding connection that electrically connects ground plane layer 12 and patch layer 14 can facilitate such impedance matching by reducing the effect that proximity to other electrically conductive materials (e.g., a metal housing) can have on the patch layer 14.

In operation, RF energy is applied to patch layer 14 via the RF feed (illustrated in FIG. 2) at RF feed location 18 to excite the electro-magnetic (EM) fields between patch layer 14 and ground plane layer 12. In response, patch antenna 10 emits and/or receives signals within a range of frequencies that are closely related to one or more exited resonant frequencies of patch layer 14. The exited resonant frequencies are dependent upon factors such as the diameter of patch layer 14, the thickness and dielectric constant of the dielectric layer, the guide wavelength of the signal in the dielectric layer, and the wavelength of the signal in free space. For instance, a fundamental excitation mode of patch layer 14 can correspond to a wavelength of emitted radiation that is approximately twice diameter $D_P$ of patch layer 14. That is, diameter $D_P$ can be approximately half of a wavelength of a signal emitted and/or sensed by patch antenna 10 at a nominal operational frequency of patch antenna 10, such as a nominal operational frequency of 2.45 GHz, 915 megahertz (MHz), or other nominal operational frequencies. In general, the nominal operational frequency of patch antenna 10 can be any operational frequency, and corresponding diameters, thicknesses, and other dimensions of patch antenna 10 can be adjusted accordingly to accommodate a particular nominal operational frequency.

Patch layer 14, in some examples, can be approximated as a half-wave resonator for its fundamental excitation mode. As one example, properties of patch antenna 10 can be estimated via the following equation:

$$D_p = 2r \approx \frac{\lambda_8}{2} = \frac{1}{2}\left(\frac{\lambda_o}{\sqrt{\varepsilon_r}}\right) \quad \text{(Equation 1)}$$

where r is the radius of the circular patch, $\in_r$ is the dielectric constant of the dielectric layer, $\lambda_g$ is the guide wavelength of the signal in the dielectric layer, and $\lambda_o$ is the wavelength of the signal in free space. As can be seen by the relationships established in Equation 1, as the dielectric constant of the dielectric layer increases, the radius (and hence the diameter) of patch layer 14 for a given wavelength decreases. In this way, diameter $D_P$ of patch layer 14 can be reduced while maintaining the same resonant frequency. Moreover, given a nominal operational frequency and a specified diameter of patch antenna 10 (or a maximum diameter), a dielectric material can be chosen such that the dielectric constant of the material satisfies Equation 1. For instance, given a maximum diameter of one inch (2.54 cm) and a nominal operational frequency of 2.45 GHz, an alumina substrate can be selected for use in the dielectric layer. As another example, a ceramic-polytetrafluoroethylene (PTFE) composite having a similar dielectric constant to alumina (e.g., approximately 9.9) can be selected.

As another example, properties of patch antenna 10 can be approximated using a cavity model that approximates a cavity composed of two perfect electric conductors representing patch layer 14 and ground plane 12, and a cylindrical perfect magnetic conductor around the circular periphery of the cavity. Using the cavity model, the resonant frequency of patch layer 14 (e.g., a circular patch layer) can be determined via the following equation:

$$f_o = \frac{cJ_{mn}}{2\pi r_{eff}\sqrt{\varepsilon_r}}, \quad \text{(Equation 2)}$$

where $f_0$ is the resonant frequency, $J_{mn}$ is the $m^{th}$ zero of the derivative of the Bessel function of order 'n', $r_{eff}$ is the effective radius of patch layer 14 (modified due to the fringing fields), and $\in_r$ is the dielectric constant of the dielectric layer.

The effective radius $r_{eff}$ of patch layer 14 can be determined according to the following equation:

$$r_{eff} = r\sqrt{1 + \frac{2h}{\pi r \varepsilon_r}\left[\ln\left(\frac{\pi r}{2h}\right) + 1.7726\right]}, \quad \text{(Equation 3)}$$

where r is the physical radius of patch layer 14, h is the thickness of the dielectric layer, and $\in_r$ is the dielectric constant of the dielectric layer. For the dominant mode $TM_{11}$, $J_{mn}$ can be approximated as 1.84118, which is an industry accepted approximation.

Using Equations 2 and 3, it can be estimated, for example, that diameter $D_P$ of patch layer 14, having a nominal operating frequency of 2.45 GHz and using a dielectric layer having a dielectric constant of 9.9 a thickness of 0.100 inches is approximately 0.85 inches (2.16 cm). As can be seen by the above relationships, an increased dielectric constant of the dielectric layer can result in a value of diameter $D_P$ of patch layer 14 that is significantly less than a half-wavelength of a signal at a nominal operational frequency of patch antenna 10. For instance, rather than a diameter of approximately 2.5 inches (6.35 cm) corresponding to a half-wavelength of a 2.45 GHz signal in air, the diameter $D_P$ of patch layer 14 can be reduced to approximately 0.85 inches (2.16 cm).

In operation, as RF energy is fed to patch layer 14 at RF feed location 18, multiple resonance modes of patch layer 14 are excited, thereby inducing circular polarization of patch antenna 10. In addition, surface currents flow from the RF feed point on patch layer 14, eventually to ground via grounding location 16. Moreover, a portion of the surface currents follow a path that circumvents one or more of voids 20, thereby increasing a path length of that portion of the currents. By increasing the path length of a portion of these currents, voids 20 can act to increase an effective diameter of patch layer 14. This is turn will increase the bandwidth of patch antenna 10.

As illustrated in FIG. 1, voids 20 can be rectangular voids having a major axis extending along axis 24A and a minor axis extending in a direction of axis 24B. In other examples, voids 20 can have other shapes, such as a square shape, an elliptical shape, or other shape. In the example of FIG. 1, patch layer 14 includes two voids 20A and 20B. In other examples, patch layer 14 can include more than two voids 20, such as three or more voids 20. In certain examples, such as the example of FIG. 1, voids 20 can be disposed symmetrically about the central axis of patch layer 14. A length of the major axis of each of voids 20, in some examples, can range from one-fifth to one-fourth of diameter $D_P$ of patch layer 14 (and hence, from approximately one-tenth to one-eighth of a RF signal wavelength at a nominal operational frequency of patch antenna 10). A length of the major axis of each of voids 20 ranging from one-fifth to one-fourth of diameter $D_P$ can, in some examples, help to increase the bandwidth of patch antenna 10 while maintaining sufficient input impedance matching performance.

As illustrated in FIG. 1, patch antenna 10 can further include tuning portion 22 that extends along a portion of an outer periphery of patch layer 14. In general, tuning portion 22 can extend along any portion of the periphery of patch antenna 10 to adjust the frequency response of patch layer 14, such as to meet specified requirements of patch antenna 10. In some examples, tuning portion 22 can extend along the periphery of one of quadrants 26 of patch layer 14. In certain examples, as in the example of FIG. 1, tuning portion 22 can extend along the periphery of one of quadrants 26 that is opposite axis 24B (i.e., an axis perpendicular to axis 24A extending through voids 20) and adjacent the one of quadrants 26 in which RF feed location 18 is disposed. For instance, in the example of FIG. 1, electrical feed location is disposed within quadrant 26A. Tuning portion 22, in this example, extends along the periphery of quadrant 26B that is adjacent quadrant 26A and opposite axis 24B.

Ground plane layer 12, as illustrated in FIG. 1, can have diameter $D_G$ that is greater than diameter $D_P$ of patch layer 14. Diameter $D_G$, in certain examples, can be less than five times diameter $D_P$ of patch layer 14. A diameter $D_G$ that is less than five times diameter $D_P$ can be termed a "finite" ground plane, while a diameter $D_G$ that is five or more times diameter $D_P$ can be termed an "infinite" ground plane. In some examples, diameter $D_P$ can be nearly equal to diameter $D_G$. For instance, a ration of diameter $D_P$ to diameter $D_G$ can be greater than 0.95.

According to techniques described herein, patch antenna 10 can be fed via a single RF feed at RF feed location 18 that is offset from a central axis of patch layer 14, thereby inducing circular polarization of radiation emitted and/or received via patch antenna 10 without the use of a hybrid coupler device to shift the phase of the input signal. Such circular polarization can facilitate the integration of patch antenna 10 into assemblies, such as a housing, that may be formed of a conductive material (e.g., metal) without sacrificing performance. Moreover, voids 20 in patch layer 14 increase an effective bandwidth of patch antenna 10. A dielectric layer formed of a material having a high dielectric constant (e.g., alumina) and a finite ground plane enable patch antenna 10 to have a physical diameter that is significantly less than a half-wavelength of a signal at a nominal operational frequency, thereby facilitating integration of patch antenna 10 into smaller assemblies and/or sub-assemblies.

Figure 2:
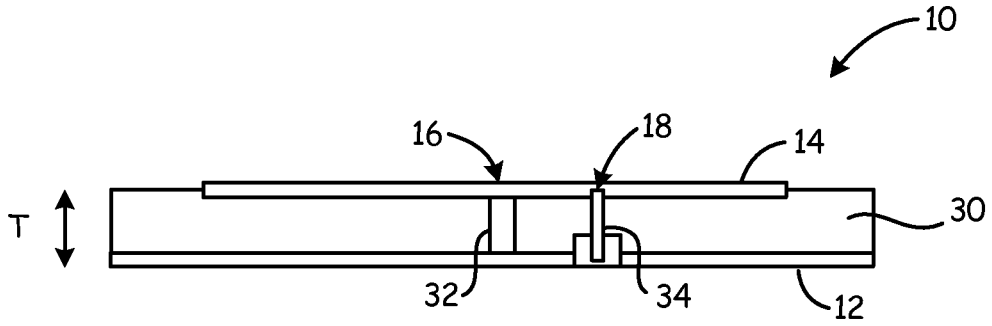
FIG. 2 is a side view of the patch antenna of FIG. 1.

FIG. 2 is a side view of patch antenna 10. As illustrated in FIG. 2, patch antenna 10 includes ground plane layer 12 and patch layer 14 separated by dielectric layer 30 having thickness T. Patch antenna 10 further includes grounding connection 32 and electrical feed 34. Grounding connection 32 extends from ground plane layer 12 through dielectric layer 30 and contacts patch layer 14 at grounding location 16 to electrically connect ground plane 12 with patch layer 14. Grounding connection 32 can be a wire, post, or other connection formed of a highly conductive material, such as metal (e.g., copper).

RF feed 34 extends through ground plane layer 12 and dielectric layer 30 to contact patch layer 14 at RF feed location 18. RF feed 34 can be a wire, a coaxial cable, or other connector capable of delivering RF energy to patch layer 14. Dielectric layer 30 is disposed between and contacts each of ground plane layer 12 and patch layer 14 (including tuning portion 22 illustrated in FIG. 1). Dielectric layer 30 can be formed of any one or more dielectric materials, such as alumina, ceramic-PTFE, quartz, FR-4 and the like.

Figure 3:
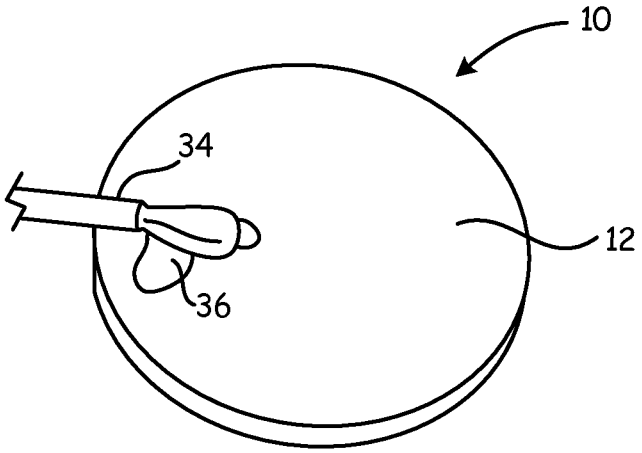
FIG. 3 is a perspective view of the back side of the patch antenna of FIG. 1 connected to an electrical feed line.

FIG. 3 is a perspective view of patch antenna 10 showing electrical feed 34 connected to a back side of ground plane layer 12. As illustrated, electrical feed 34 can be a coaxial cable that connects to patch antenna 10 via an orifice through ground plane layer 12. Electrical feed 34 can attach (e.g., via solder) to ground plane layer 12 at mounting location 36 to help relieve strain on electrical feed 34 during assembly and operation of patch antenna 10.

Figure 4:
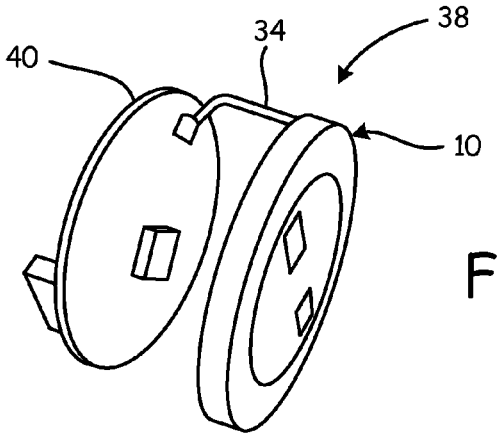
FIG. 4 is a perspective view of an assembly including the patch antenna of FIG. 1 electrically connected to an electronics module.

FIG. 4 is a perspective view of assembly 38 including patch antenna 10 and electronics module 40. In general, electronics module 40 can be any electrical module that can provide RF signal to patch antenna 10 to cause patch antenna 10 to transmit and/or receive radio frequency (RF) signals. For instance, as in the example of FIG. 4, electronics module 40 can be a printed circuit board. Electronics module 40 is electrically connected to patch antenna 10 via electrical feed 34.

Figure 5:
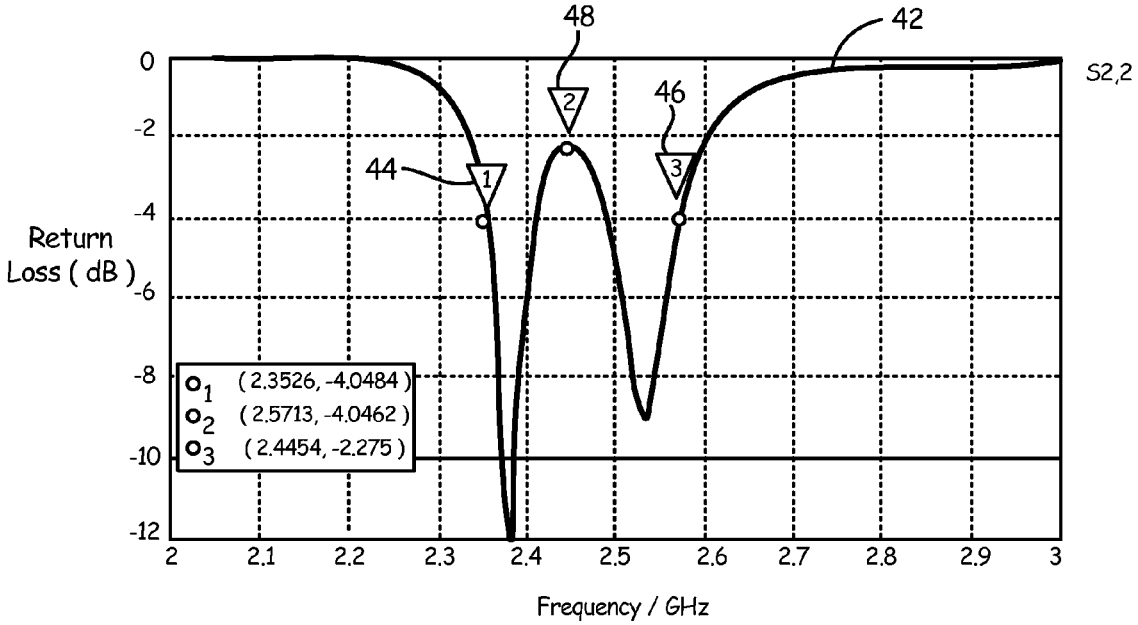
FIG. 5 is a graph of a predicted input return loss of a patch antenna.

FIG. 5 is a graph of a predicted input return loss 42 of patch antenna 10 that was obtained via mathematical modeling techniques. In the example of FIG. 5, dielectric layer 30 has a thickness T of 2.54 millimeters (mm) and is formed of a material having a dielectric constant of approximately 10.2. In addition, patch layer 14 has diameter $D_P$ of 20 mm, and each of slots 20 have major dimensions of 7 mm and minor dimensions of 4 mm. Tuning portion 22, in the example of FIG. 5, extends along a periphery of quadrant 26B and has a width of 0.5 mm.

As illustrated in FIG. 5, a predicted bandwidth of patch antenna 10 ranges from a frequency of 2.3526 GHz at location 44 to a frequency of 2.5713 GHz at location 46. Input return loss 42 has a predicted maximum value of −2.275 decibels (dB) within the bandwidth region at location 48, which determines a predicted threshold sensitivity of patch antenna 10 for operation within the bandwidth region. As described herein, each of the diameter $D_P$ of patch layer 20, the dielectric constant and thickness of dielectric layer 30, the location and size of voids 20 within patch layer 12, the position of feed location 18, the diameter $D_G$ of ground plane layer 12, and the position and size of tuning portion 22 contribute to increase return loss 42 to help maximize the desired bandwidth range (e.g., 10 dB). As such, patch antenna 10 can transmit and/or receive signals at a nominal operational frequency (e.g., 2.45 GHz) utilizing a patch layer (e.g., patch layer 14) and finite ground plane layer (e.g., ground plane layer 12) having a maximum outer diameter that is significantly less than a half-wavelength of the signal at the nominal operational frequency in air.

Figure 6:
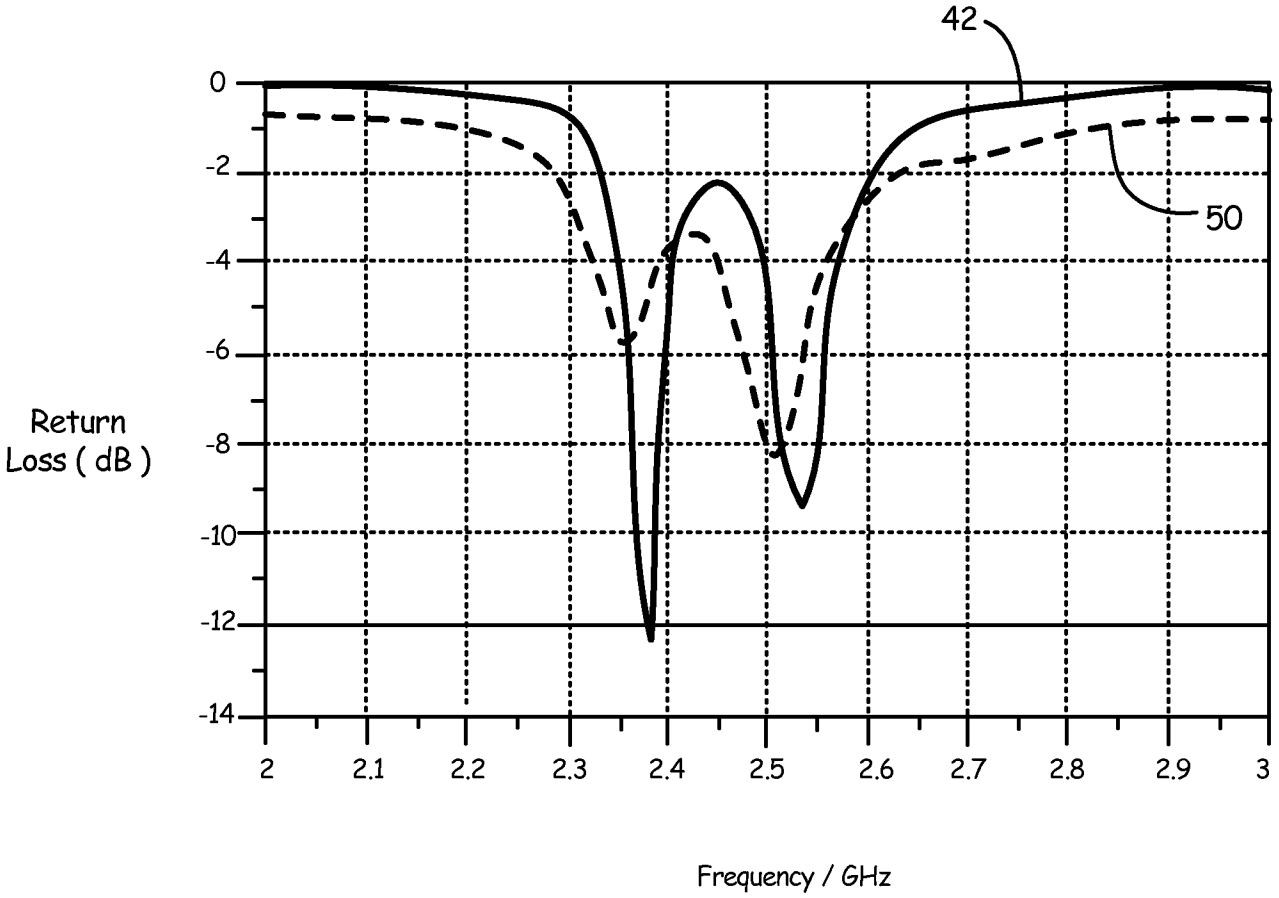
FIG. 6 is a graph of the predicted input return loss of FIG. 5 and a measured input return loss of a corresponding patch antenna.

FIG. 6 is a graph of predicted input return loss 42 and measured input return loss 50 corresponding to patch antenna 10 as described above with respect to FIG. 5. That is, FIG. 6 shows a graph of predicted input return loss 42 and a corresponding measured input return loss 50 for patch antenna 10 where dielectric layer 30 has a thickness T of 2.54 millimeters (mm) and is formed of a material having a dielectric constant of approximately 10.2, patch layer 14 has diameter $D_P$ of 20 mm, each of slots 20 have major dimensions of 7 mm and minor dimensions of 4 mm, and tuning portion 22 extends along a periphery of quadrant 26B and has a width of 0.5 mm.

As illustrated in FIG. 6, predicted input loss 42 and measured input loss 50 show basic agreement with respect to bandwidth and resonant modes. Discrepancies between predicted input loss 42 and measured input los 50 can be attributed to, in part, the use of relatively long test cables (e.g., six inch test cables), as well as simplifications and approximations of the prediction model.

Figure 7:
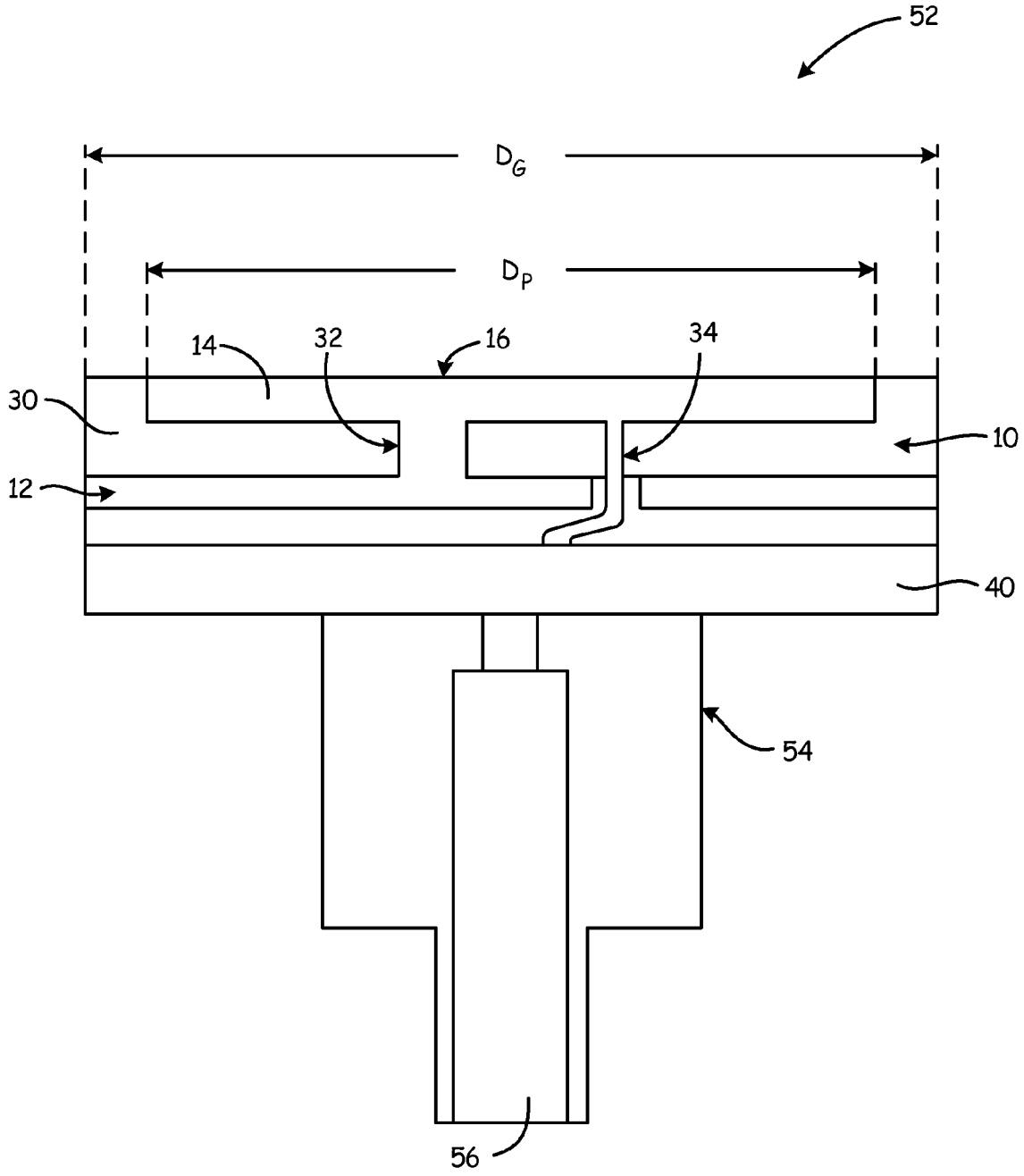
FIG. 7 is a schematic diagram of a wireless latch sensor including a patch antenna.

FIG. 7 is a schematic diagram of wireless latch sensor 52 including patch antenna 10. As illustrated in FIG. 7, wireless latch sensor 52 can include housing 54. Each of patch antenna 10, electronics module 40, and sensor 56 can be disposed within housing 54. Housing 54 can be formed of any one or more rigid and/or semi-rigid materials, such as plastic, ceramic, metal (e.g., stainless steel, aluminum, etc.) or other such materials. Examples of sensor 56 can include pressure sensors, temperature sensors, flow sensors, or other types of sensors. As illustrated, patch antenna 10 can be disposed within housing 54 such that an outer periphery of patch antenna 10 abuts housing 54. In other examples, patch antenna 10 can be disposed within housing 54 such that patch antenna 10 does not contact housing 54. In operation, sensor 56 senses one or more parameters (e.g., temperature, pressure, etc.) and transmits an indication of the parameter to electronics module 40, which can be a printed circuit board, a printed circuit board including a radio unit, an application specific integrated circuit (ASIC), a processor, a field programmable gate array (FPGA), or other type of electronics module. Electronics module 40 connects to patch antenna 10 via electrical feed 34 to cause patch antenna 10 to transmit an RF signal corresponding to the sensed parameter.

It should be understood, however, that wireless latch sensor 52 is just one example of an assembly into which patch antenna 10 can be integrated. There may be many more suitable applications and assemblies for which techniques of this disclosure may find applicability.

The following are non-exclusive descriptions of possible embodiments of the present invention.

A patch antenna includes a conductive ground plane layer, a conductive circular patch layer, a dielectric layer, a grounding connection, and a RF feed. The conductive circular patch layer includes a plurality of voids. The dielectric layer is disposed between and contacts each of the ground plane layer and the circular patch layer. The grounding connection extends from the ground plane layer through the dielectric layer and contacts the circular patch layer at a grounding location of the circular patch layer. The RF feed extends through the ground plane layer and the dielectric layer and contacts the circular patch layer at a RF feed location of the circular patch layer. The RF feed location is offset from a central axis of the circular patch layer.

The patch antenna of the preceding paragraph can optionally include, additionally and/or alternatively, any one or more of the following features, configurations and/or additional components:

The grounding location can be disposed at the central axis of the circular patch layer.

The plurality of voids can be disposed symmetrically about the grounding location.

An angle between a first line extending from the grounding location to the RF feed location and a second line extending through the plurality of voids can be between forty-three degrees and forty-seven degrees.

A diameter of the circular patch layer can be equal to half of a wavelength in the dielectric layer of a signal at a nominal operational frequency of the patch antenna. A diameter of the ground plane layer can be greater than the diameter of the circular patch layer. A ratio of the diameter of the circular patch layer to the diameter of the ground plane layer can be greater than 0.95.

The dielectric layer can be formed of a low-loss material having a dielectric constant between 1.0 and 50.0.

The low-loss material can include alumina.

Each of the plurality of voids can be a rectangular void.

Each of the plurality of rectangular voids can have a length along a major axis of the respective one of the plurality of rectangular voids that ranges from one-tenth to one-eighth of a wavelength of a signal at a nominal operational frequency of the patch antenna.

The patch antenna can further include a tuning portion that extends along a portion of an outer periphery of the circular patch layer.

The plurality of voids can be disposed symmetrically about the grounding location. A first axis extending through each of the plurality of voids and a second axis extending perpendicular to the first axis can define four quadrants of the circular patch layer. The tuning portion can extend along an outer periphery of a first quadrant. The RF feed location can be disposed within a second quadrant, the second quadrant opposite the second axis and adjacent the first quadrant.

A nominal operational frequency of the patch antenna can be 2.45 gigahertz (GHz).

An assembly includes an electronics module, a patch antenna, and an electrical cable. The patch antenna includes a conductive ground plane layer, a conductive circular patch layer, a dielectric layer, a grounding connection, and a RF feed. The conductive circular patch layer includes a plurality of voids. The dielectric layer is disposed between and contacts each of the ground plane layer and the circular patch layer. The grounding connection extends from the ground plane layer through the dielectric layer and contacts the circular patch layer at a grounding location of the circular patch layer. The RF feed extends through the ground plane layer and the dielectric layer and contacts the circular patch layer at a RF feed location of the circular patch layer. The RF feed location is offset from a central axis of the circular patch layer.

The assembly of the preceding paragraph can optionally include, additionally and/or alternatively, any one or more of the following features, configurations and/or additional components:

The assembly can further include a housing. Each of the electronics module, the patch antenna, and the electrical cable can be disposed within the housing.

The housing can be formed of metal.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A patch antenna comprising:

a conductive ground plane layer;

a conductive circular patch layer comprising a plurality of voids;

a dielectric layer disposed between and contacting each of the ground plane layer and the circular patch layer;

a grounding connection extending from the ground plane layer through the dielectric layer and contacting the circular patch layer at a grounding location of the circular patch layer;

a RF feed extending through the ground plane layer and the dielectric layer and contacting the circular patch layer at an electrical feed location of the circular patch layer; and a tuning portion that extends along a portion of an outer periphery of the circular patch layer;

wherein the electrical feed location is offset from a central axis of the circular patch layer;

wherein the plurality of voids are disposed symmetrically about the grounding location;

wherein a first axis extending through each of the plurality of voids and a second axis extending perpendicular to the first axis define four quadrants of the circular patch layer;

wherein the tuning portion extends along an outer periphery of a first quadrant of the four quadrants; and wherein the RF feed location is disposed within a second quadrant of the four quadrants, the second quadrant opposite the second axis and adjacent the first quadrant.

2. The patch antenna of claim 1, wherein the grounding location is disposed at the central axis of the circular patch layer.

3. The patch antenna of claim 2, wherein an angle between a first line extending from the grounding location to the RF feed location and a second line extending through the plurality of voids is between forty-three degrees and forty-seven degrees.

4. The patch antenna of claim 1, wherein a diameter of the circular patch layer is equal to half of a wavelength in the dielectric layer of a signal at a nominal operational frequency of the patch antenna;

wherein a diameter of the ground plane layer is greater than the diameter of the circular patch layer; and wherein a ratio of the diameter of the circular patch layer to the diameter of the ground plane layer is greater than 0.95.

5. The patch antenna of claim 1, wherein the dielectric layer is formed of a low-loss material having a dielectric constant between 1.0 and 50.0.

6. The patch antenna of claim 5, wherein the low-loss material comprises alumina.

7. The patch antenna of claim 1, wherein each of the plurality of voids comprises a rectangular void.

8. The patch antenna of claim 7, wherein each of the plurality of rectangular voids has a length along a major axis of the respective one of the plurality of rectangular voids that ranges from one-tenth to one-eighth of a wavelength of a signal at a nominal operational frequency of the patch antenna.

9. The patch antenna of claim 1, wherein a nominal operational frequency of the patch antenna is 2.45 gigahertz (GHz).

10. An assembly comprising:

an electronics module;

a patch antenna comprising:

a conductive ground plane layer;

a conductive circular patch layer having a plurality of voids;

a dielectric layer disposed between and contacting each of the ground plane layer and the circular patch layer;

a grounding connection extending from the ground plane layer through the dielectric layer and contacting the circular patch layer at a grounding location of the circular patch layer;

a RF feed extending through the ground plane layer and the dielectric layer and contacting the circular patch layer at a RF feed location of the circular patch layer, wherein the RF feed location is offset from a central axis of the circular patch layer; and a tuning portion that extends along a portion of an outer periphery of the circular patch antenna;

wherein the plurality of voids are disposed symmetrically about the grounding location;

wherein a first axis extending through each of the plurality of voids and a second axis extending perpendicular to the first axis define four quadrants of the circular patch layer;

wherein the tuning portion extends along an outer periphery of a first quadrant of the four quadrants; and wherein the RF feed location is disposed within a second quadrant of the four quadrants, the second quadrant opposite the second axis and adjacent the first quadrant; and an electrical cable connecting the electronics module and the RF feed.

11. The assembly of claim 10, further comprising:

a housing;

wherein each of the electronics module, the patch antenna, and the electrical cable are disposed within the housing.

12. The assembly of claim 11, wherein the housing is formed of metal.

* * * * *